US010484790B1

(12) United States Patent
Kim et al.

(10) Patent No.: US 10,484,790 B1
(45) Date of Patent: Nov. 19, 2019

(54) SPEAKER DEVICE FOR VEHICLE

(71) Applicants: HYUNDAI MOTOR COMPANY, Seoul (KR); KIA MOTORS CORPORATION, Seoul (KR)

(72) Inventors: Byoungyoon Kim, Seoul (KR); Yonghwan Hwang, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/255,540

(22) Filed: Jan. 23, 2019

(30) Foreign Application Priority Data

Oct. 23, 2018 (KR) ..... 10-2018-0126968

(51) Int. Cl.
*H04R 1/34* (2006.01)
*H04R 1/28* (2006.01)
*H04R 1/02* (2006.01)

(52) U.S. Cl.
CPC ..... *H04R 1/345* (2013.01); *H04R 1/025* (2013.01); *H04R 1/2811* (2013.01); *H04R 2499/13* (2013.01)

(58) Field of Classification Search
CPC ..... H04R 1/345; H04R 1/025; H04R 1/2811; H04R 2499/13
See application file for complete search history.

(56) References Cited

U.S. PATENT DOCUMENTS 2,210,477 A * 8/1940 Benecke ..... H04R 1/345 181/150
4,322,578 A * 3/1982 Selmin ..... H04R 1/345 181/175
2017/0303034 A1* 10/2017 Sullivan ..... H04R 1/345

* cited by examiner

*Primary Examiner* — Andrew L Sniezek
(74) *Attorney, Agent, or Firm* — Brinks Gilson & Lione

(57) ABSTRACT

Disclosed is a speaker device for a vehicle capable of directing sounds in a wide frequency range. The speaker device includes: a speaker unit, and an acoustic reflector unit provided on an upper portion of the speaker unit. In particular, the acoustic reflector unit includes a plurality of acoustic reflectors having different curvatures, and the plurality of acoustic reflectors are provided to be stacked on one another.

10 Claims, 5 Drawing Sheets

SPEAKER DEVICE FOR VEHICLE

CROSS-REFERENCE TO RELATED APPLICATIONS

This application claims priority to and the benefit of Korean Patent Application No. 10-2018-0126968, filed on Oct. 23, 2018, the entire contents of which are incorporated herein by reference.

FIELD

The present disclosure relates to a speaker device for a vehicle, and more particularly to a speaker device for a vehicle capable of directing sounds in a wide frequency range.

BACKGROUND

The statements in this section merely provide background information related to the present disclosure and may not constitute prior art.

Generally, an audio system is installed in a vehicle so that a driver may listen to radio broadcasts and music while riding in the vehicle.

The audio system for a vehicle mainly includes an antenna, a media source (a radio tuner, a cassette player, a CD player, etc.), a sound wave corrector, an audible frequency amplifier, and a speaker.

Among the components constituting the audio system for a vehicle, the speaker is an important component for determining the indoor acoustic performance of the vehicle, and a woofer speaker for mid and low frequency ranges and a tweeter speaker for a high frequency range in order to realize stereo music may be used.

Among these two types of speakers, the tweeter speaker outputs a high frequency range of sounds with a short wavelength and strong directivity, and has characteristics that the sound quality characteristic of the audio system greatly changes according to the output direction.

We have discovered that such tweeter speaker has a problem in that the transmission efficiency is good only at a specific frequency range and the efficiency is reduced at other frequency ranges.

SUMMARY

It is an aspect of the present disclosure to provide a speaker device for a vehicle capable of directing sounds in a wide frequency range.

It is another aspect of the present disclosure to provide a speaker device for a vehicle capable of being adjusted up, down, left, and right so as to provide a high acoustic directivity to a plurality of users' ears.

Additional aspects of the present disclosure will be set forth in part in the description which follows and, in part, will be obvious from the description, or may be learned by practice of the disclosure.

In accordance with an aspect of the present disclosure, a speaker device for a vehicle includes: a speaker unit, and an acoustic reflector unit provided on an upper portion of the speaker unit. In particular, the acoustic reflector unit includes a plurality of acoustic reflectors having different curvatures, and acoustic reflectors of the plurality of acoustic reflectors are provided to be stacked on one another.

The acoustic reflectors of the plurality of acoustic reflectors are formed in different sizes.

The acoustic reflectors of the plurality of acoustic reflectors are formed in a dome shape.

The acoustic reflector unit includes a plurality of acoustic filters, and acoustic filters of the plurality of acoustic filters are ring-shaped.

The acoustic filters of the plurality of acoustic filters and the acoustic reflectors of the plurality of acoustic reflectors are alternatively disposed.

The acoustic filters of the plurality of acoustic filters are formed in different sizes.

The acoustic reflector unit includes a rotation unit for rotating the plurality of acoustic reflectors.

The acoustic reflector unit includes a driving unit provided to move the plurality of acoustic reflectors up and down.

In accordance with another aspect of the present disclosure, a speaker device for a vehicle includes a speaker unit, and an acoustic reflector unit disposed on an upper portion of the speaker unit. In particular, the acoustic reflector unit includes a plurality of acoustic reflectors having different curvatures and an acoustic filter provided at each acoustic reflector of the plurality of acoustic reflectors, and acoustic reflectors of the plurality of acoustic reflectors and the acoustic filters are alternately stacked on one another.

The acoustic reflectors of the plurality of acoustic reflectors are formed in a dome shape.

The acoustic filters are formed in a ring shape.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
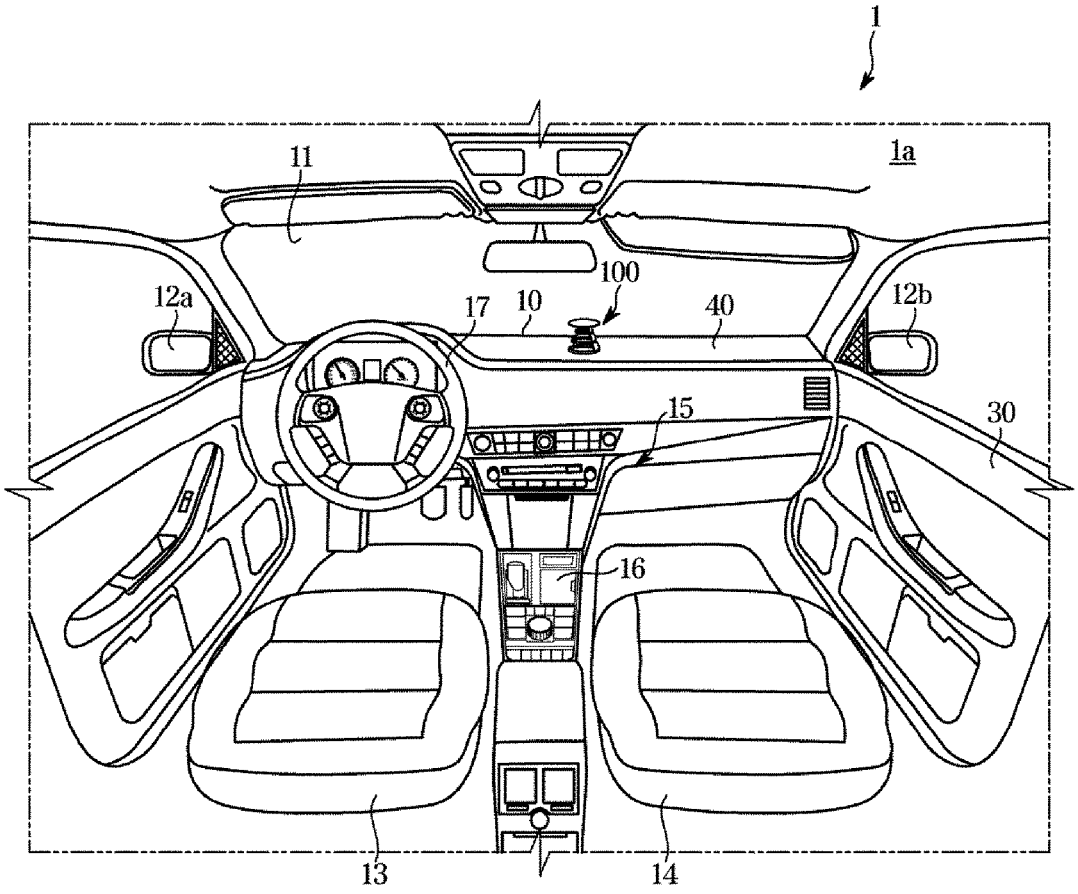
FIG. 1 is a view illustrating a vehicle equipped with a speaker device.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The forms described herein and the configurations shown in the drawings are only exemplary forms of the present disclosure, and various modifications may be made at the time of filing of the present disclosure to replace the forms and drawings of the present disclosure.

Like reference numbers or designations in the various figures of the present disclosure represent parts or components that perform substantially the same functions.

The terms used herein are for the purpose of describing the forms and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front," "rear," "upper," "lower," "left," and "right" are defined with reference to the drawings, and the shape and position of each component are not limited by these terms.

In the following description, a vehicle refers to various devices for moving an object to be transported, such as a person, a thing, or an animal, from an origin to a destination. The vehicle may include a vehicle that runs on roads or rails, a ship that moves over the sea or river, and an airplane that flies into the sky using the action of air.

Also, the vehicle traveling on roads or rails may move in a predetermined direction in accordance with the rotation of at least one wheel, and may include, for example, a three- or four-wheeled vehicle, a construction machine, a two-wheeled vehicle, a prime mover, a bicycle, and a train that runs on rails.

Hereinafter, forms according to the present disclosure will be described in detail with reference to the accompanying drawings.

Figure 2:
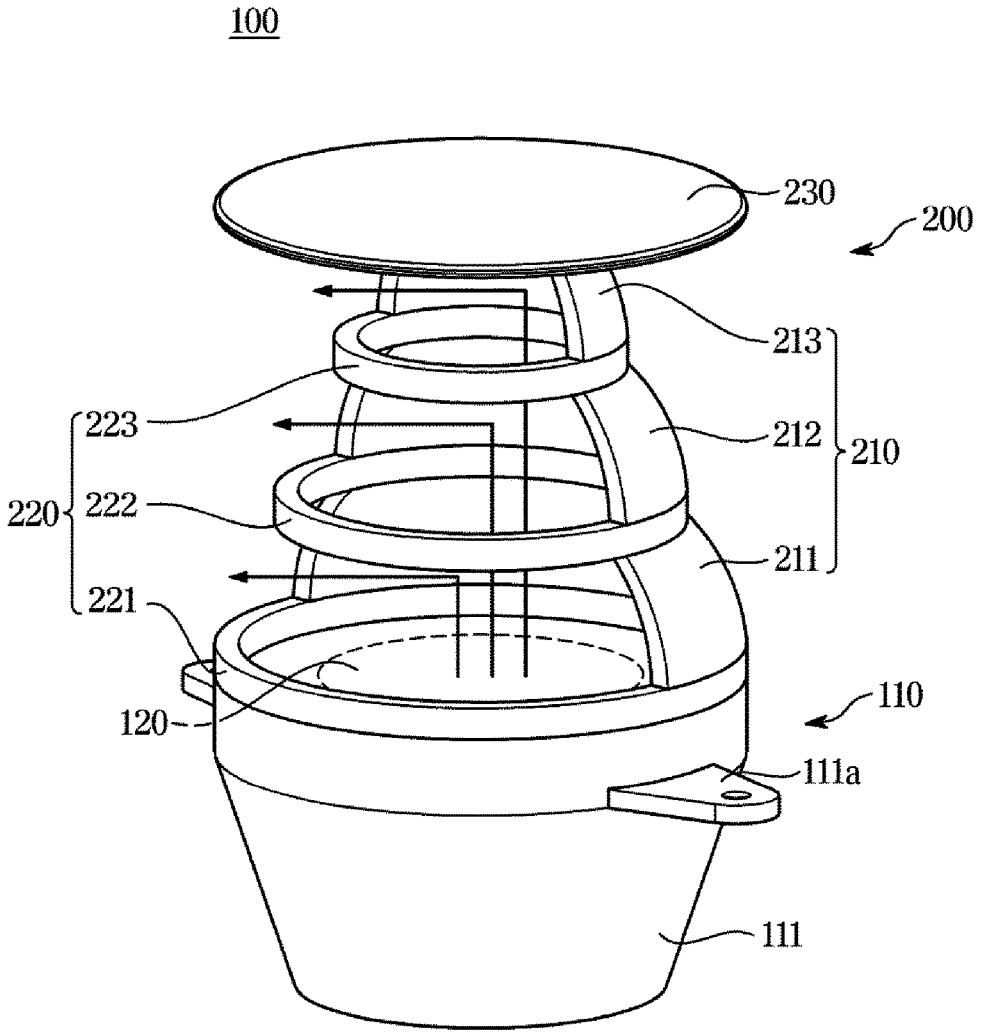
FIG. 2 is a view illustrating a speaker device for a vehicle.

FIG. 1 is a view illustrating a vehicle equipped with a speaker device according to an exemplary form of the present disclosure, and FIG. 2 is a view illustrating a speaker device for a vehicle in one form of the present disclosure.

As illustrated in FIGS. 1 and 2, a vehicle 1 may include: a main body 10 forming an outer appearance of the vehicle 1, a front glass 11 for providing a front view of the vehicle 1 to a driver inside the vehicle 1, doors 30 for shielding the inside of the vehicle 1 from the outside, and side mirrors 12*a* and 12*b* for providing a rear view of the vehicle 1 to the driver.

The doors 30 are rotatably provided on the left and right sides of the main body 10, respectively, so that the doors 30 may allow the driver and a passenger to ride inside the vehicle 1 when the doors 30 are opened and shield the inside of the vehicle 1 from the outside when the doors 30 are closed.

The side mirrors 12*a* and 12*b* may be provided on the left and right sides of the main body 10, respectively, so that the driver inside the vehicle 1 may obtain sight information on the sides and rear of the vehicle.

A driver's seat 13, a passenger seat 14, and a dashboard 40 are provided in an interior 1*a* of the vehicle 1.

The dashboard 40 refers to a panel for partitioning the interior 1*a* of the vehicle 1 and an engine room (not shown) and installing various components desired for driving. The dashboard 40 is provided in a front direction of the driver's seat 13 and the passenger seat 14. The dashboard 40 may include a center fascia 15, a gear box 16, and a steering wheel 17 provided so as to be able to transmit a rotational force generated by the driver to wheels (not shown).

The steering wheel 17 is provided to be rotatable in a predetermined direction according to the manipulation of the driver, and may steer the vehicle 1 by rotating the front wheels or the rear wheels of the vehicle 1 in accordance with the direction of rotation of the steering wheel 17. The steering wheel 17 may be provided with input means for inputting various commands, and the input means may be implemented by using physical buttons, knobs, touch pads, touch screens, stick type operation devices, trackballs, or the like.

Also, although not shown in the drawings, the vehicle 1 may include a front camera for securing a front view, a left camera or a right camera for securing a side view, and may include a sensing device such as a proximity sensor for detecting an obstacle in the rear of the vehicle or a rain sensor for detecting rainfall and precipitation.

A speaker device 100 for a vehicle may be provided on the dashboard 40 of the main body 10. The speaker device 100 may be installed in a form capable of transmitting sound to the outside.

Although the present disclosure has exemplified that the one speaker device 100 is disposed in front of the main body 10, the spirit of the present disclosure is not limited thereto. For example, a plurality of the speaker devices may be provided to transmit sound from the left side and the right side of the vehicle, respectively.

The speaker device 100 may include a speaker unit 110 disposed to be recessed inside the dashboard 40 and an acoustic reflector unit 200 provided on an upper portion of the speaker unit 110.

The speaker unit 110 may include a tweeter 120 for generating a high sound and a frame 111 in which the tweeter 120 is installed. The frame 111 may be provided with brackets 111*a* for fixing the speaker unit 110 to the dashboard 40.

Although not shown, the speaker unit 110 includes a magnetic circuit part and a vibrating part. The magnetic circuit part includes a yoke coupled to the inside of the frame 111 and magnets and plates sequentially stacked inside the yoke. In this case, a gap is formed between an inner circumferential surface of the yoke and an outer circumferential surface of the magnet, and between the inner circumferential surface of the yoke and an outer circumferential surface of the plate.

The vibrating part includes a vibrating plate, and a voice coil in which an upper side thereof is coupled to the vibrating plate and a lower side thereof is located in the gap of the magnetic circuit part.

Accordingly, when an external current is applied to the voice coil, the voice coil is vibrated in a vertical direction by the action of the voice coil and the magnetic circuit part, and thereby the vibrating plate vibrates in the vertical direction to reproduce a high sound.

The speaker unit 110 including the tweeter 120 has high directivity in the 10 kHz to 20 kHz frequency band and needs to concentrate the sound wave in the direction of a user. The speaker device 100 according to the present disclosure includes the acoustic reflector unit 200. The acoustic reflector unit 200 may be positioned at an upper portion of the speaker unit 110.

Figure 3:
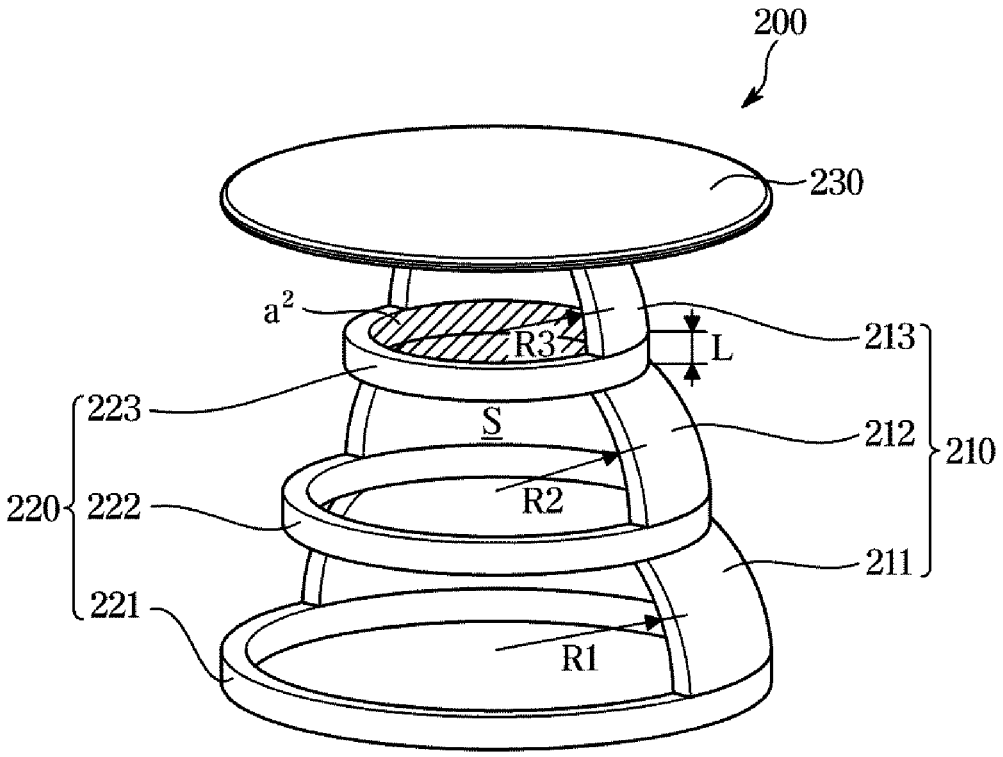
FIG. 3 is a perspective view illustrating an acoustic reflector unit of a speaker device.
Figure 4:
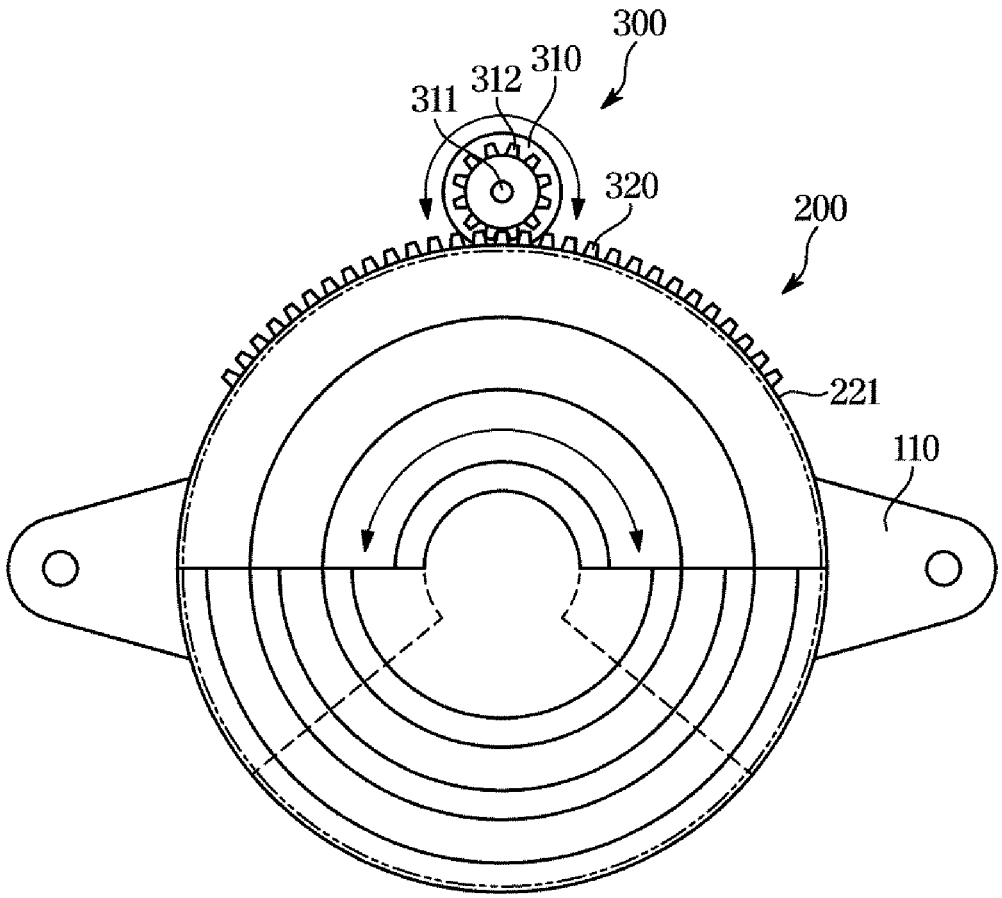
FIG. 4 is a view illustrating a rotation unit of an acoustic reflector unit.
Figure 5:
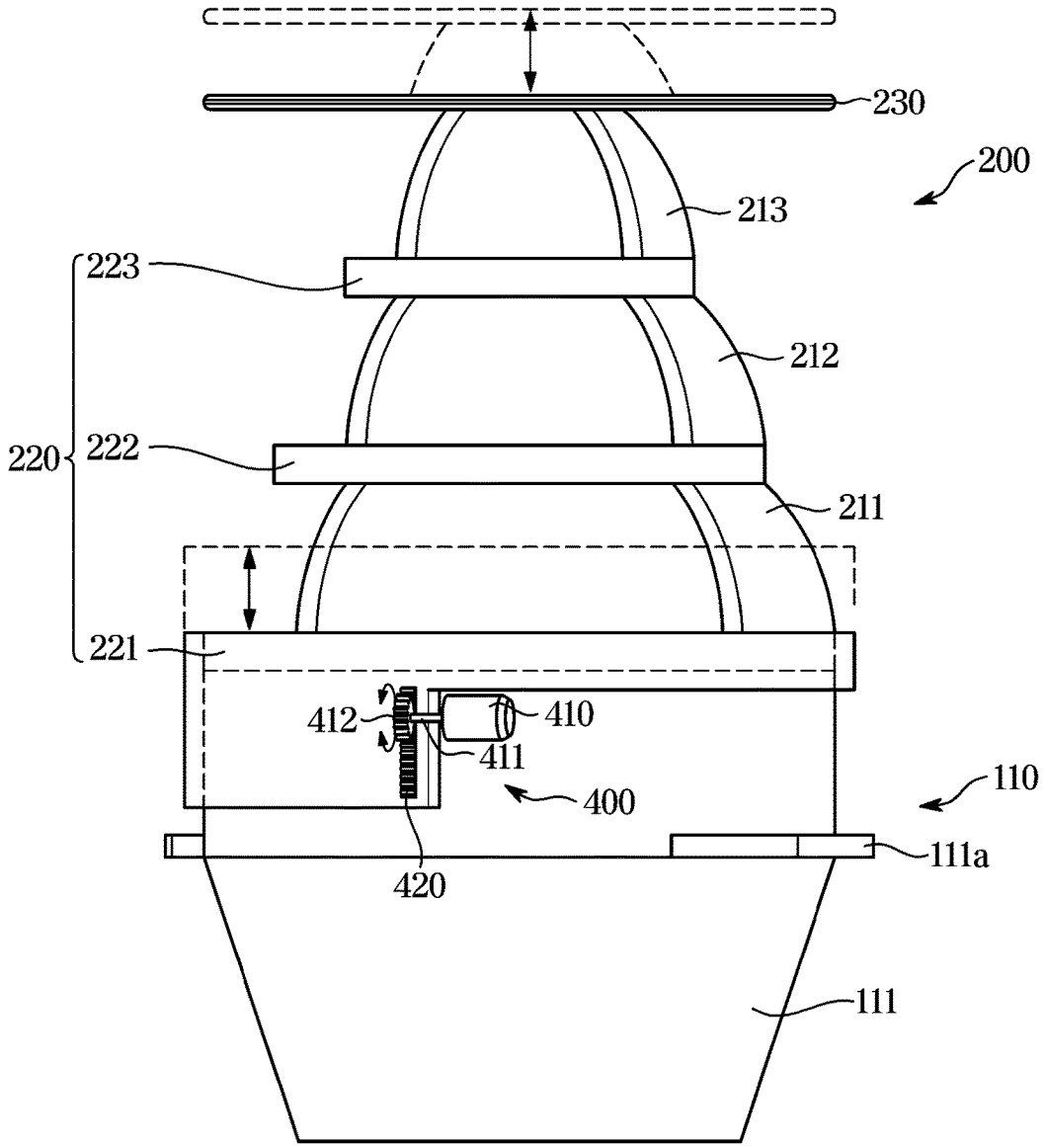
FIG. 5 is a view illustrating a driving unit of an acoustic reflector unit.

FIG. 3 is a perspective view illustrating an acoustic reflector unit of a speaker device according to one form of the present disclosure, FIG. 4 is a view illustrating a rotation unit of an acoustic reflector unit according to an exemplary form of the present disclosure, and FIG. 5 is a view illustrating a driving unit of an acoustic reflector unit according to another form of the present disclosure.

As illustrated in FIGS. 3 to 5, the acoustic reflector unit 200 of the speaker device 100 performs a function of reflecting the sound emitted from the tweeter 120.

The acoustic reflector unit 200 is provided in the speaker unit 110 to extend a reflection frequency band of sound. The acoustic reflector unit 200 is disposed on an upper side of the speaker unit 110 to output a wide frequency band.

The acoustic reflector unit 200 may include a plurality of acoustic reflectors 210 having different curvatures. The acoustic reflectors 210 may be formed in a dome shape. The dome-shaped acoustic reflectors 210 may be formed with different curvatures and sizes. The plurality of acoustic reflectors 210 of different sizes may be provided to be stacked on the upper side of the speaker unit 110. The plurality of acoustic reflectors 210 of different sizes may be provided to reflect sounds of different frequency bands to the respective acoustic reflectors 210.

The acoustic reflector 210 may include a first reflector 211 having a first curvature R1, a second reflector 212 having a second curvature R2, and a third reflector 213 having a third curvature R3, The acoustic reflector 210 may be formed in a dome shape having an upper surface and a lower surface opened.

The acoustic reflector 210 may include at least one of metal, plastic, and ceramic.

The second reflector 212 may be disposed on the first reflector 211. The third reflector 213 may be disposed on the second reflector 212.

A lower surface of the first reflector 211 may have a size and a shape corresponding to an upper end of the speaker unit 110. The first reflector 211 may be formed in a size and a shape corresponding to an upper edge of the speaker unit 110.

Sound may be transmitted from the speaker unit 110 disposed below the first reflector 211 to the entrance of the first reflector 211.

The acoustic reflector unit 200 may further include an acoustic filter 220. A plurality of the acoustic filters 220 may be formed. The acoustic filters 220 may be disposed between the acoustic reflectors 210. The acoustic filters 220 may be formed in a ring shape. The acoustic filters 220 are provided so as to increase the transmission efficiency of a specific frequency range when sounds move to the acoustic reflectors 210 positioned above the acoustic filters 220.

The acoustic filter 220 may include a first acoustic filter 221 disposed between the speaker unit 110 and the first reflector 211, a second acoustic filter 222 disposed between the first reflector 211 and the second reflector 212, and a third acoustic filter 223 disposed between the second reflector 212 and the third reflector 213.

The acoustic filters 220 and the acoustic reflectors 210 may be arranged alternately with each other.

A reflector cover 230 may be provided on an upper end of the acoustic reflector unit 200. The reflector cover 230 is provided to cover an upper surface of the third reflector 213.

The first acoustic filter 221 may transmit the sound waves transmitted from the speaker unit 110 disposed at the lowermost end of the acoustic reflector unit 200 to the first reflector 211, so that sound waves in a specific frequency range may be reflected through the first reflector 211 to be directed to the user.

The sound waves in a region higher than the frequency reflected by the first reflector 211 are filtered through the second acoustic filter 222 provided at the upper portion of the first reflector 211 and transmitted to the second reflector 212. The sound waves transmitted to the second reflector 212 through the second acoustic filter 222 are reflected by the second reflector 212 and transmitted to the user.

The sound waves reflected by the second reflector 212 are higher in frequency than the sound waves reflected by the first reflector 211.

Likewise, the sound waves in a region higher than the frequency reflected by the second reflector 212 are filtered through the third acoustic filter 223 provided at the upper portion of the second reflector 212 and transmitted to the third reflector 213. The sound waves transmitted to the third reflector 213 through the third acoustic filter 223 are reflected by the third reflector 213 and transmitted to the user.

The sound waves reflected by the third reflector 213 are higher in frequency than the sound waves reflected by the second reflector 212.

Each of the acoustic reflectors 210 may adjust the curvatures R1, R2, and R3 to adjust the acoustic reflection.

The acoustic filter 220 may adjust the frequency region to be filtered by adjusting the cross-sectional area, length, the amount of the mesh, or the like.

In addition, the acoustic filter 220 may include an acoustic high pass filter structure in order to increase the transmission efficiency of a desired frequency band when sound waves are transmitted to the acoustic reflector 210 disposed on the upper side of the acoustic filter 220.

The acoustic high pass filter structure follows the principle of the following formula 1 when the length of the filter is L and the width of the filter hole is $a^2$.

$$Fc=(ca^2/2SL)$$

Then, a desired cut-off frequency may be obtained by adjusting a cross-sectional area S of the reflector.

The speaker device 100 includes a rotation unit 300 for rotating the acoustic reflectors 210.

The rotation unit 300 includes a rotation motor 310, and a first gear 312 provided on a rotation shaft 311 of the rotation motor 310.

The acoustic reflector unit 200 may be provided with a second gear 320 so as to be engaged with the first gear 312 of the rotation unit 300. The second gear 320 may be formed on at least one of the acoustic reflectors 210 of the acoustic reflector unit 200. The second gear 320 may be formed on at least one of the acoustic filters 220 of the acoustic reflector unit 200. Although FIG. 4 illustrates that the second gear 320 is formed on an outer circumferential surface of the first acoustic filter 221, the spirit of the present disclosure is not limited thereto. For example, the second gear 320 may be formed on an outer circumferential surface of at least one of the acoustic reflectors 210.

When the rotation motor 310 rotates, the first gear 312 connected to the rotation shaft 311 of the rotation motor 310 is rotated, and the acoustic reflector unit 200 is rotated to the left and right by the second gear 320 engaged with the first gear 312.

Thus, the directivity of a plurality of the user's ears may be enhanced by the acoustic reflector unit 200 which is rotatable in the left and right direction.

The speaker device 100 may also include a driving unit 400 for moving the acoustic reflector 210 up and down. The driving unit 400 includes a driving motor 410, and a rotation gear 412 provided on a driving shaft 411 of the driving motor 410.

The acoustic reflector unit 200 may be provided with a moving gear 420 so as to be engaged with the rotation gear 412 of the rotation unit 300. The moving gear 420 may be formed on at least one of the acoustic filters 220 of the acoustic reflector unit 200, The moving gear 420 may be formed in a vertical direction of the first acoustic filter 221. In this case, the first acoustic filter 221 may extend to a predetermined length so that the moving gear 420 may be formed to allow the acoustic reflector unit 200 to move up and down.

Although FIG. 5 illustrates that the moving gear 420 is formed on the outer circumferential surface of the first acoustic filter 221, the spirit of the present disclosure is not limited thereto. When the driving motor 410 rotates, the rotation gear 412 connected to the driving shaft 411 of the driving motor 410 is rotated, and the acoustic reflector unit 200 is rotated up and down by the moving gear 420 engaged with the rotation gear 412.

Thus, the directivity of the plurality of user's ears may be enhanced by the acoustic reflector unit 200 which is rotatable in the left and right direction.

As is apparent from the above, the speaker device for a vehicle according to the present disclosure is capable of directing sounds in a wide frequency range and enhancing sound transmission efficiency through an acoustic filter.

Further, the speaker device for a vehicle according to the present disclosure is capable of providing a high sound with high sound quality to the user.

Further, the speaker device for a vehicle according to the present disclosure is capable of being adjusted up, down, right and left so that it is possible to design a tweeter with high directivity to any user.

Further, the speaker device for a vehicle according to the present disclosure is capable of adjusting the direction in which it is directed so that it can be mounted at various positions, thereby improving the degree of design freedom.

The forms disclosed with reference to the accompanying drawings have been described above. It will be understood by those skilled in the art that various changes in form and details may be made therein without departing from the spirit and scope of the present disclosure. The disclosed exemplary forms are illustrative and should not be construed as limiting.

What is claimed is:

1. A speaker device for a vehicle, comprising:
a speaker unit; and
an acoustic reflector unit provided on an upper portion of the speaker unit,
wherein the acoustic reflector unit includes a plurality of acoustic reflectors having different curvatures, and acoustic reflectors of the plurality of acoustic reflectors are provided to be stacked on one another, and
wherein the acoustic reflector unit includes a rotation unit configured to rotate the plurality of acoustic reflectors.

2. The speaker device according to claim 1, wherein the acoustic reflectors of the plurality of acoustic reflectors are formed in different sizes.

3. The speaker device according to claim 2, wherein the acoustic reflectors of the plurality of acoustic reflectors are formed in a dome shape.

4. The speaker device according to claim 3, wherein
the acoustic reflector unit includes a plurality of acoustic filters, and acoustic filters of the plurality of acoustic filters are ring-shaped.

5. The speaker device according to claim 4, wherein
the acoustic filters of the plurality of acoustic filters and the acoustic reflectors of the plurality of acoustic reflectors are alternatively disposed.

6. The speaker device according to claim 4, wherein
the acoustic filters of the plurality of acoustic filters are formed in different sizes.

7. The speaker device according to claim 1, wherein
the acoustic reflector unit includes a driving unit configured to move the plurality of acoustic reflectors up and down.

8. A speaker device for a vehicle comprising:
a speaker unit; and
an acoustic reflector unit disposed on an upper portion of the speaker unit,
wherein the acoustic reflector unit includes a plurality of acoustic reflectors having different curvatures and an acoustic filter provided at each acoustic reflector of the plurality of acoustic reflectors, and
acoustic reflectors of the plurality of acoustic reflectors and the acoustic filters are alternately stacked on one another.

9. The speaker device according to claim 8, wherein
the acoustic reflectors of the plurality of acoustic reflectors are formed in a dome shape.

10. The speaker device according to claim 8, wherein
the acoustic filters are formed in a ring shape.

* * * * *